US009156645B2

(12) United States Patent
Tsuji et al.

(10) Patent No.: US 9,156,645 B2
(45) Date of Patent: Oct. 13, 2015

(54) SHEET STORAGE APPARATUS AND IMAGE FORMING APPARATUS

(71) Applicant: CANON KABUSHIKI KAISHA, Tokyo (JP)

(72) Inventors: Hiroharu Tsuji, Numazu (JP); Masayoshi Fukatsu, Suntou-gun (JP); Yohei Suzuki, Suntou-gun (JP); Daisuke Kaneko, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/165,314

(22) Filed: Jan. 27, 2014

(65) Prior Publication Data

US 2014/0210163 A1 Jul. 31, 2014

(30) Foreign Application Priority Data

Jan. 30, 2013 (JP) ..... 2013-015895

(51) Int. Cl.

*B65H 31/24* (2006.01)
*B65H 31/30* (2006.01)
*G03G 15/00* (2006.01)

(52) U.S. Cl.

CPC ..... *B65H 31/24* (2013.01); *B65H 31/3081* (2013.01); *G03G 15/6538* (2013.01); *B65H 2402/443* (2013.01); *B65H 2405/111* (2013.01); *B65H 2405/115* (2013.01); *B65H 2405/1124* (2013.01); *B65H 2405/332* (2013.01); *B65H 2407/33* (2013.01); *B65H 2511/21* (2013.01); *B65H 2511/412* (2013.01); *B65H 2801/06* (2013.01)

(58) Field of Classification Search

CPC ..... B65H 31/24; B65H 31/3081; B65H 2405/1124; B65H 2405/332; B65H 2402/443; B65H 2407/33

USPC ..... 271/207, 224, 287, 298

See application file for complete search history.

(56) References Cited

U.S. PATENT DOCUMENTS

| | | | | |
|---|---|---|---|---|
| 6,421,582 | B1 * | 7/2002 | Wada | 700/232 |
| 8,820,742 | B2 * | 9/2014 | Koyanagi et al. | 271/279 |
| 2013/0264771 | A1 * | 10/2013 | Koyanagi et al. | 271/279 |

FOREIGN PATENT DOCUMENTS

JP 2001-031327 A 2/2001

* cited by examiner

*Primary Examiner* — Patrick Cicchino

(74) *Attorney, Agent, or Firm* — Canon USA, Inc., IP Division

(57) ABSTRACT

A sheet storage apparatus for storing sheets including a sheet storage unit including a lower guide configured to guide a lower surface of the conveyed sheet, an upper guide configured to guide an upper surface of the conveyed sheet, and a shutting-off unit provided in one of the lower guide and the upper guide, configured to be movable around a rotational axis and between a shutting-off position at which a downstream end of the conveying direction of the sheet stored in the sheet storage unit is shut off and a retracting position for retracting from the shutting-off position, and a plurality of stages of sheet storage units is vertically stacked and at least a part of the shutting-off unit overlaps the rotational axis of the adjacent sheet storage unit in a vertical direction at the shutting-off position.

21 Claims, 13 Drawing Sheets

SHEET STORAGE APPARATUS AND IMAGE FORMING APPARATUS

BACKGROUND OF THE INVENTION

1. Field of the Invention

The present invention relates to a sheet storage apparatus, and an image forming apparatus including the sheet storage apparatus.

2. Description of the Related Art

Conventionally, there has been an image forming apparatus such as a copying machine that temporarily stores an image-formed sheet in a sheet storage unit and discharges the stored sheet so that a user can receive the sheet by an operation (button operation or identification (ID) authentication).

Japanese Patent Application Laid-Open No. 2001-31327 discusses a sheet storage apparatus configured to allow a user to receive a sheet stored in a storage bin via an outlet opening. This sheet storage apparatus includes a shutter for closing the outlet opening. When the user receives the sheet, the storage bin is moved to an outlet opening position, and the shutter is opened.

In the sheet storage apparatus discussed in Japanese Patent Application Laid-Open No. 2001-31327, because of the necessity of moving the storage bin to the outlet opening position, a mechanism for moving the storage bin must be provided. This creates a problem of enlargement of the apparatus.

SUMMARY OF THE INVENTION

The present disclosure is directed to miniaturization of a sheet storage apparatus including a sheet storage unit in a height direction.

According to an aspect of the present disclosure, a sheet storage apparatus for storing sheets includes a sheet storage unit configured to store a sheet conveyed by a sheet conveyance unit. The sheet storage unit includes a lower guide configured to guide a lower surface of the conveyed sheet, an upper guide configured to guide an upper surface of the conveyed sheet, and a shutting-off unit provided in one of the lower guide and the upper guide, configured to be movable around a rotational axis extending in a direction orthogonal to a conveying direction of the sheet between a shutting-off position at which a downstream end of the conveying direction of the sheet stored in the sheet storage unit is shut off and a retracting position for retracting from the shutting-off position, wherein a plurality of stages of sheet storage units are vertically stacked and wherein at least a part of the shutting-off unit overlaps the rotational axis of the adjacent sheet storage unit in a vertical direction at the shutting-off position.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1A:
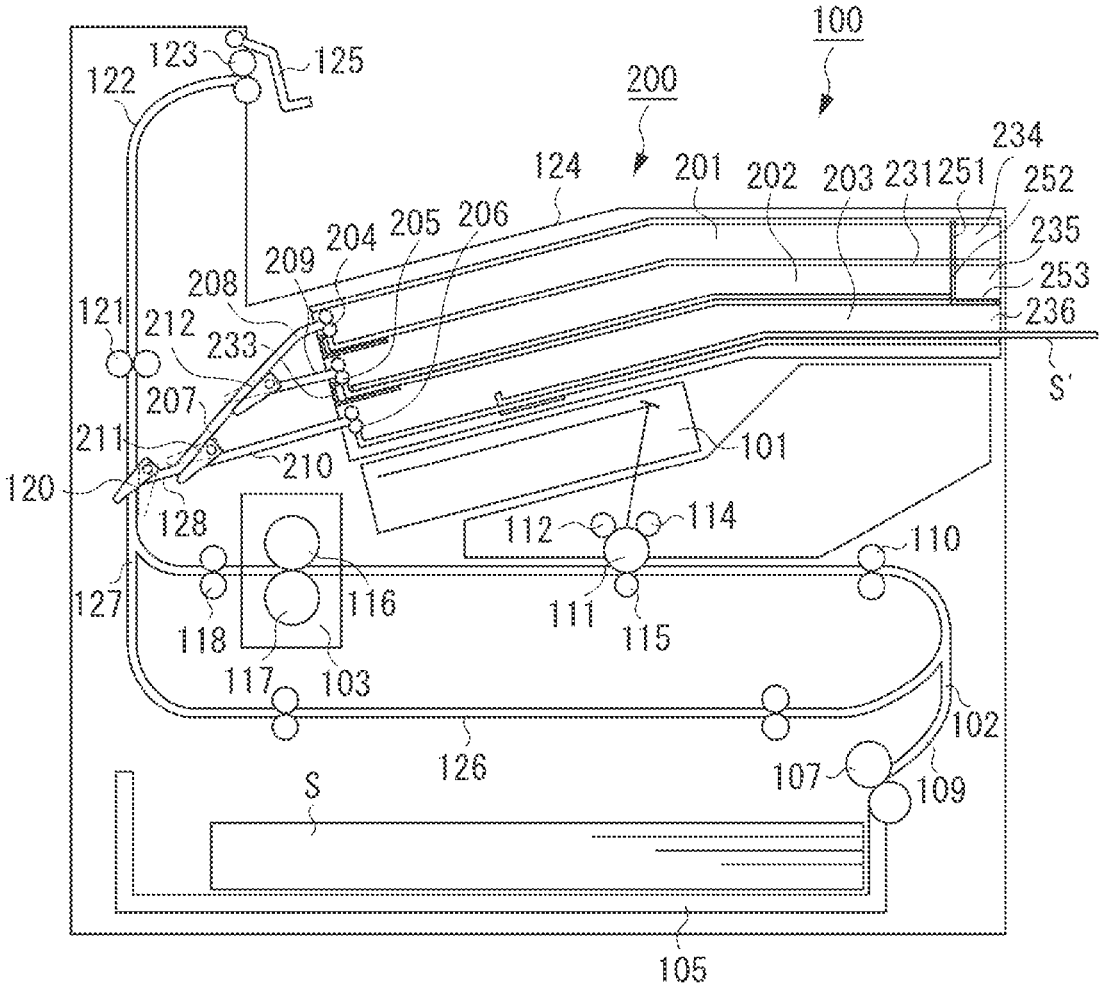
FIGS. 1A and 1B are diagrams illustrating an image forming apparatus according to a first exemplary embodiment.
Figure 1B:
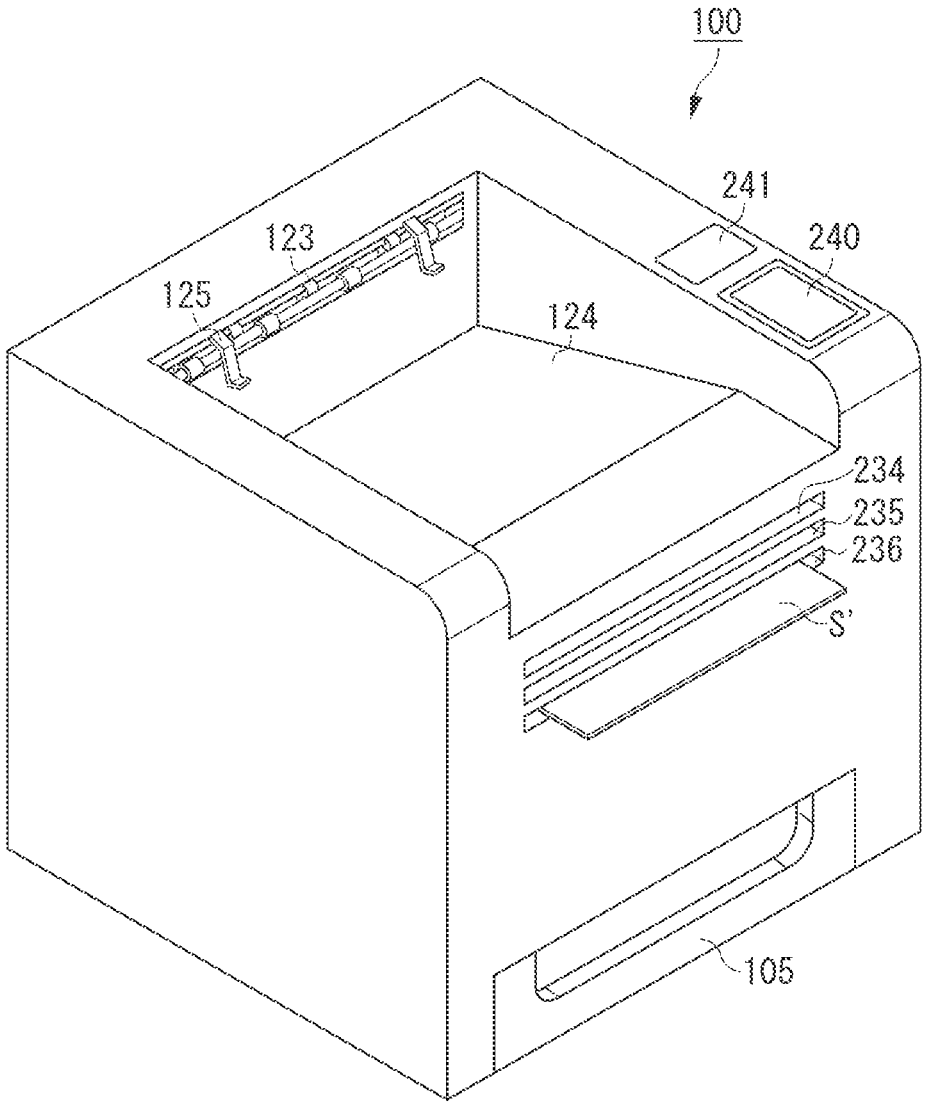

FIG. 1A is a schematic sectional view illustrating a monochrome digital printer as an example of an image forming apparatus according to a first exemplary embodiment. FIG. 1B is a perspective view illustrating the monochrome digital printer.

In FIGS. 1A and 1B, an image forming apparatus body (hereinafter, referred to as an apparatus body) 100 includes a sheet feeding unit 102 feeding a sheet, and an image forming unit 101 forming an image on the fed sheet. The image formed on the sheet is fixed on the sheet by a fixing unit 103.

A stacking unit 124, which is provided on an upper surface of the apparatus body 100, stacks the sheet on which the image has been formed by the image forming unit 101. Sheet storage units 201, 202, and 203, which store the sheet on which the image has been formed by the image forming unit 101, are provided between the image forming unit 101 and the stacking unit 124.

The image forming unit 101 includes a photosensitive drum 111 rotating clockwise in FIG. 1A, an exposure device, a charging roller 112, a developing device 114, and a transfer roller 115. A charging roller 112, a developing device 114, and a transfer roller 115 are arranged almost sequentially along a rotational direction of the photosensitive drum 111. The image forming apparatus 101 forms a toner image on a sheet S through an image forming process.

The sheet feeding unit 102 includes a feeding cassette 105 storing a plurality of sheets S supplied for image formation in a stacked state, a feeding roller 107, a conveyance guide 109, and a registration roller 110. The fixing roller 103 includes a fixing roller 116, and a pressure roller 117 abutted on the fixing roller 116 from below. A conveyance roller 118 is provided on the downstream side of the fixing unit 103.

A reconveyance passage 126 of the sheet S, which is used for forming images on both front and rear surfaces of the sheet S, is provided among the image forming unit 101, the fixing unit 103, and the feeding cassette 105.

When images are formed on both surfaces of the sheet, the sheet having a toner image fixed on one of its surfaces (front surface) is conveyed toward a reversing roller 123. After a trailing end of the sheet has exited from a branch unit 127, a conveyance roller 121 and the reversing roller 123 are reversely rotated to switch back the sheet. Then, the sheet passes through the reconveyance passage 126 to be conveyed to the image forming apparatus 101.

In the image forming apparatus according to the present exemplary embodiment, a plurality of sheet storage units, which is vertically stacked, is a first sheet storage unit 201, a second sheet storage unit 202, and a third sheet storage unit 203 in order from above.

A conveyance roller 204 serves as a sheet conveyance unit conveying the image-formed sheet to the first sheet storage unit 201. Similarly, a conveyance roller 205 conveys the sheet to the second sheet storage unit 202, and a conveyance roller 206 conveys the sheet to the third sheet storage unit 203.

A conveyance path switching member 120 can be switched between a first position indicated by a solid line in FIG. 1A for feeding the image-formed sheet to the sheet storage unit and a second position indicated by a broken line for discharging the sheet to the stacking unit 124. The conveyance path switching member 120 is configured to be switched between the position indicated by the solid line and the position indicated by the broken line in FIG. 1A by an actuator (not illustrated). The conveyance roller 121 and the reversing roller 123, which are provided to be rotatable normally and reversely, convey the sheet to the stacking unit 124 with a normal rotation, and convey to the image forming unit 101 again with a reverse rotation.

When the sheet is discharged to the staking unit 124, the conveyance path switching member 120 is switched to the position indicated by the broken line. The sheet is conveyed along a discharging guide 122 by the conveyance roller 121 to be discharged to the stacking unit 124 by the reversing roller 123. As illustrated in FIGS. 1A and 1B, the stacking unit 124, which is provided in the upper surface of the apparatus body, can be shared by a plurality of users.

A full-state detection sensor lever 125 detects a full-state of sheets stacked in the stacking unit 124. When the full-state detection sensor lever 125 detects a full-state of sheets, a control unit (not illustrated) performs control so as not to form any images on the sheets until the sheets are removed from the stacking unit 124.

When the sheet is conveyed to the sheet storage units, the conveyance path switching member 120 is switched to the position indicated by the solid line. The sheet is conveyed through a conveyance path 128 to a sheet storage apparatus 200.

Each of a first switching member 211 and a second switching member 212, which is provided for switching a path to convey the sheet, is switched between the position indicated by the solid line and the position indicated by the broken line in FIG. 1A by the actuator (not illustrated).

When the sheet S is conveyed to the first sheet storage unit 201, the first switching member 211 and the second switching member 212 are switched to the position indicated by the solid line in FIG. 1A to be held. The image-formed sheet is sequentially passed through the conveyance path 128 and conveyance guides 207 and 208, and then is conveyed to the first sheet storage unit 201 by the conveyance roller 204.

When the sheet S is conveyed to the second sheet storage unit 202, the first and second switching members 211 and 212 are respectively switched to the position indicated by the solid line and the position indicated by the broken line in FIG. 1A to be held. The image-formed sheet is sequentially passed through the conveyance path 128 and the conveyance guides 207 and 209, and then is conveyed to the second sheet storage unit 202 by the conveyance roller 205.

When the sheet S is conveyed to the third sheet storage unit 203, the first switching member 211 is switched to the position indicated by the broken line in FIG. 1A to be held. The image-formed sheet is sequentially passed through the conveyance path 128 and a conveyance guide 210, and then is conveyed to the third sheet storage unit 203 by the conveyance roller 206.

Next, a configuration of the sheet storage unit will be described in detail below. In the image forming apparatus according to the present exemplary embodiment, the plurality of stages of sheet storage units is vertically stacked. Each of the sheet storage unit is similar in configuration. In the following description, the configuration of the first sheet storage unit will be mainly described.

The sheet conveyed to the first sheet storage unit 201 by the conveyance roller 204 is temporarily stacked on a stacking surface 231 to be stored. Whether there is any sheet stacked on the stacking surface 231 is detected by a sheet presence detection unit (not illustrated). An extrusion unit 233 extrudes a conveying-direction upstream end (trailing end) of the stored sheet to expose a part of a conveying-direction downstream end (leading end) of the stored sheet out of the apparatus body 100 from a discharge opening.

Shutting-off units (hereinafter, referred to as shutters) 251, 252, and 253 are respectively provided on the downstream sides of the sheet storage units 201, 202, and 203. The shutter is switched by an actuator 254 between a position (a position 251 or 252 illustrated in FIG. 1A) shutting off the sheet conveyance path and a retracting position (a position 253 illustrated in FIG. 1A) not blocking a sheet discharging when the sheet is discharged.

When the sheet is conveyed and stacked in the sheet storage unit 201, the sheet has shut off its leading end by the shutter 251 set at a shutting-off position. When the sheets are continuously conveyed and stacked in the sheet storage unit 201, a succeeding sheet is conveyed while its leading end side is rubbed on a preceding stacked sheet, and the preceding sheet may be extruded. The shutter is provided to prevent such extrusion.

The shutter is provided in a positional relationship so that a distance between the conveyance roller and the shutter is equal to or slightly longer than a length of the stored sheet. When the sheet is discharged from the sheet storage unit 201, the shutter 251 is switched to the retracting position by the actuator 254, thereby enabling the sheet to be discharged. A configuration and an operation of the shutter 251 will be described in detail below.

Figure 2A:
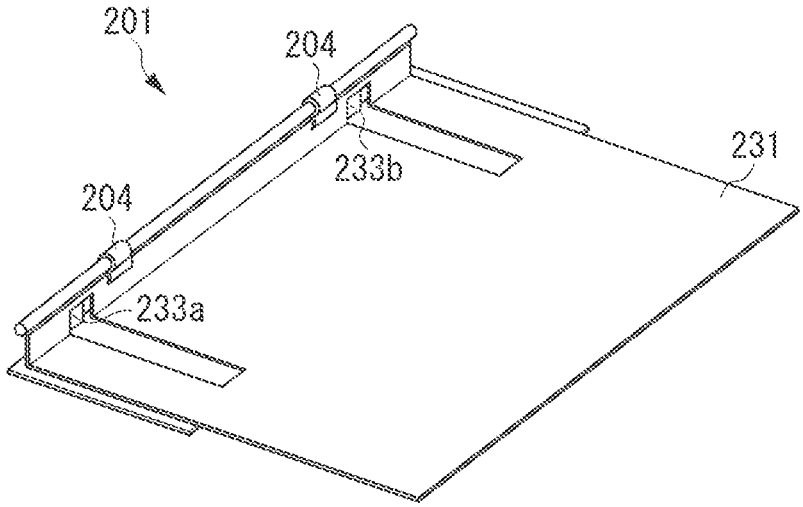
FIGS. 2A and 2B are diagrams illustrating a configuration of a sheet storage unit according to the first exemplary embodiment.
Figure 2B:
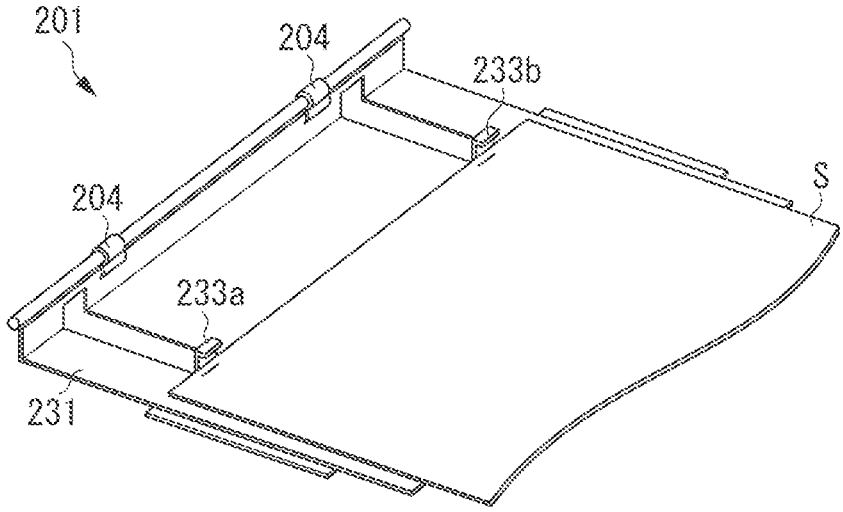

FIGS. 2A and 2B are perspective views illustrating the extrusion unit 233. FIG. 2A illustrates a case where the extrusion unit 233 is at a position (a retracting position) not interfering with sheet stacking in the sheet storage unit. FIG. 2B illustrates a case where the extrusion unit 233 is at a sheet discharging position when the stored sheet is exposed out of the apparatus body 100. The extrusion unit 233 includes two trailing end pressing claws 233*a* and 233*b* along a sheet width direction to prevent rotation of the sheet S during the sheet discharging. When the sheet is extruded, the trailing end pressing claws 233*a* and 233*b* press the upstream end of the sheet S to perform the sheet discharging. The extrusion unit 233, which is connected to an actuator 239, is reciprocated in a sheet discharging direction between the sheet retracting position and the sheet discharging position by driving the actuator 239 to rotate normally and reversely.

A state where the sheet has thus been extruded to the discharge opening by the sheet extrusion unit 233 is illustrated as a state of the sheet storage unit 203 illustrated in FIGS. 1A and 1B. A part of the stored sheet is extruded from each of the discharge opening 234 to 236. Accordingly, a user can receive his own job sheet by picking the leading end of the extruded sheet to remove the sheet.

Figure 3:
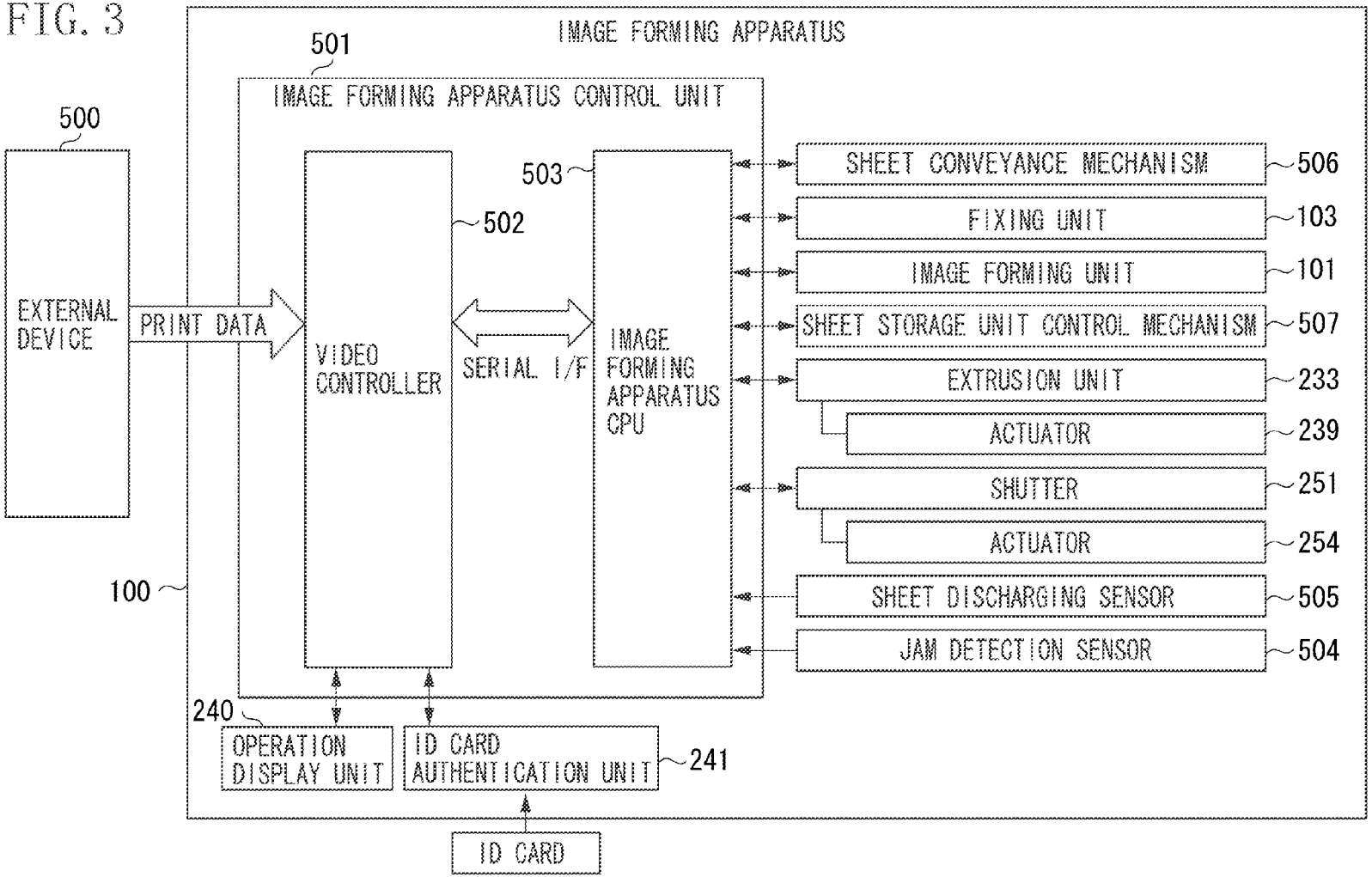
FIG. 3 is a block diagram illustrating the image forming apparatus according to the present exemplary embodiment.

FIG. 3 is a block diagram illustrating the control unit and the function configuration of the image forming apparatus illustrated in FIGS. 1A and 1B and FIGS. 2A and 2B.

The image forming apparatus 100 includes an image forming apparatus control unit 501 as a control unit. The image forming apparatus control unit 501 includes a video controller 502 and an image forming apparatus central processing unit (CPU) 503.

The video controller 502 communicates with an external device 500 such as a host computer to receive print data (including control information such as code data based on predetermined programming language, or image data). The video controller 502 designates printing conditions (the discharge opening or the like) generated from the print data to the image forming apparatus CPU 503 via a serial interface (I/F) to instruct printing. The video controller 502 instructs the image forming apparatus CPU 503 to perform discharging from the sheet storage apparatus 200 based on user information, which is input via an operation display unit 240 or is obtained from an ID card by an ID card authentication unit 241.

In addition to controlling printing, the image forming apparatus CPU 503 detects an error such as jamming at the image forming apparatus 100 based on information from a jam detection sensor 504 to notify the video controller 502 of it according to the printing conditions received from the video controller 502. The image forming apparatus CPU 503 controls a sheet conveyance mechanism 506 to perform a sheet feeding or discharging operation, and controls the image forming unit 101 and the fixing unit 103 to perform an image forming operation and a fixing operation. The image forming apparatus CPU 503 controls a sheet storage unit control mechanism 507 including conveyance rollers 204 to 206 to convey the image-formed sheet to the sheet storage unit. The image forming apparatus CPU 503 controls the sheet extrusion unit 233 and the shutter according to an instruction from the video controller 502 to control discharging of the sheet stored in the sheet storage unit by using information of a connected sheet discharging sensor 505.

Referring to FIGS. 1A and 1B again, the operation of the sheet storage unit will be described. When instructing printing with regard to the apparatus body 100 from the external device 500, the user can select discharging his job sheet to the stacking unit 124 or temporary storing it in the sheet storage unit on the external device 500.

When the user selects storing one's job sheet in the sheet storage unit, the control unit 501 searches for a sheet storage unit where no sheet has been stored based on a detection result of a sheet presence detection unit provided in each sheet storage unit to determine a sheet conveyance destination.

For example, when the sheet conveyance destination is determined to be the first sheet storage unit 201, the switching members are switched to convey the sheet onto the stacking surface 231 of the first sheet storage unit 201.

The control unit 501 can designate a sheet storage unit, which has already stored sheets, as a storage destination if a job is the same user's since the control unit 501 has information about which sheet storage unit whose job has been stored in. The user is not required to designate which sheet storage unit stores his job. The sheet is automatically stored in an empty sheet storage unit each time.

The sheet stored in each sheet storage unit cannot be removed from the outside of the apparatus body. The sheet stored in the sheet storage unit is extruded by the extrusion unit according to a user's discharging instruction, and a discharging operation is started. The discharging instruction is executed by pressing of a discharging operation start button at an operation display unit provided in the apparatus body, ID card authentication, or issuance of a discharging operation start command on the external device connected to the image forming apparatus. A specific method for issuing the discharging operation start command at the operation unit is as follows. For example, a name or a personal ID number of a user having his job stored in the sheet storage unit is displayed on the operation display unit 240 provided in the apparatus body, and a discharging instruction can be issued by operating through a place corresponding to the user. When user authentication is performed by using an ID card, the ID card authentication unit 241 is attached to the apparatus body. Then, a sheet discharging instruction can be issued by obtaining ID information.

The video controller 502, which has received the sheet discharging instruction, issues the sheet discharging instruction to the image forming apparatus CPU 503. The image forming apparatus CPU 503 controls the actuator to move the extrusion unit from a stacking position to an extruding position.

In this case, information about the user who has instructed printing of the sheet stored in the sheet storage unit has been stored in a storage unit. In other words, since the information about which sheet storage unit whose job has been stored in has been stored, the user is not required to recognize which sheet storage unit his job has been stored in. The user can receive his job by issuing the sheet discharging instruction.

Near the discharge openings 234 to 236, a discharging sensor (not illustrated) is provided as a detection unit detecting removal of a sheet bundle B by the user. After the removal of the sheet bundle B has been detected by the discharging sensor (not illustrated), the extrusion unit 233 moves from the extruding position to the stacking position. Further, when the sheet presence detection unit detects that no sheet has been stacked in the sheet storage unit, the control unit 501 deletes sheet storage information, and the sheet storage unit is enabled to store a new sheet.

Next, a configuration and operation of the shutter will be described in detail.

Figure 4A:
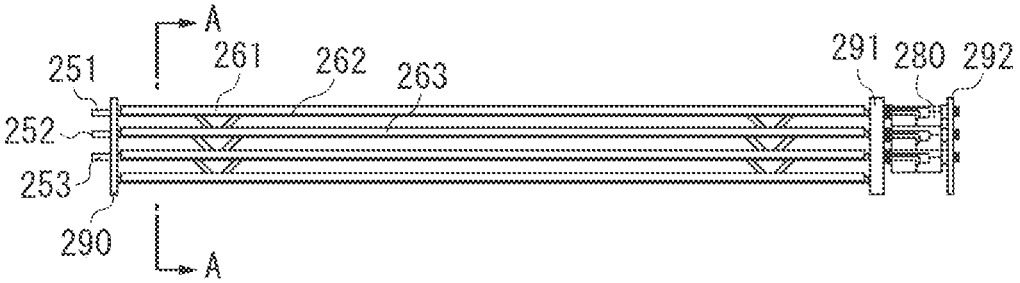
FIGS. 4A, 4B, and 4C are diagrams illustrating, respectively, the sheet storage unit, a schematic sectional view of the sheet storage unit, and a schematic sectional view of the sheet storage unit according to the first exemplary embodiment.
Figure 4B:
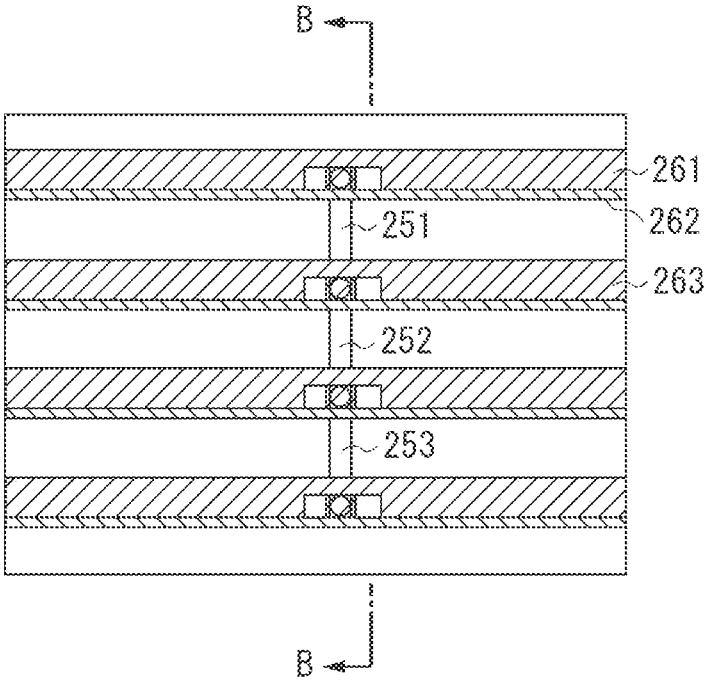
Figure 4C:
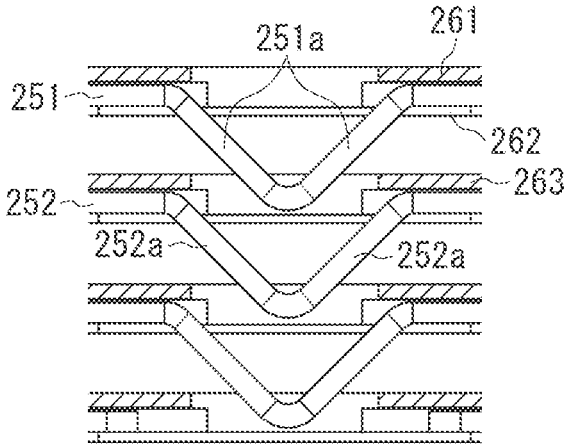
Figure 5:
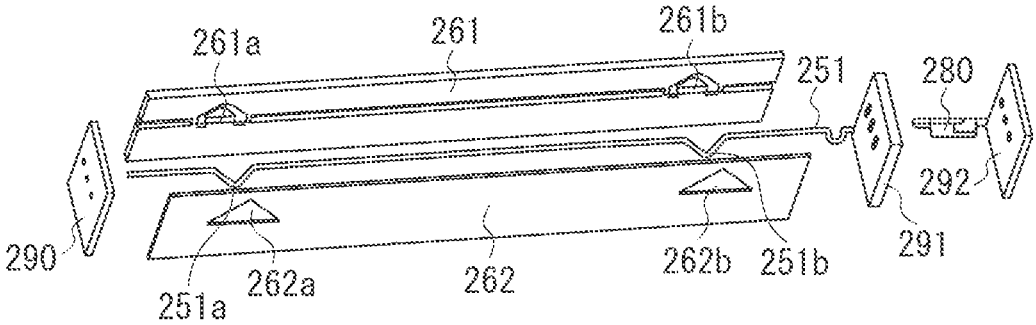
FIG. 5 is a perspective view illustrating developed peripheral components of a shutter according to the first exemplary embodiment.

FIG. 4A is a diagram illustrating the sheet storage unit seen from a sheet discharging direction (right direction illustrated in FIG. 1A). FIG. 4B is a schematic sectional diagram taken along the line A-A illustrated in FIG. 4A. FIG. 4C is a sectional diagram taken along the line B-B illustrated in FIG. 4B. FIG. 5 is a perspective view illustrating developed peripheral components of the shutter.

The shutter 251 (shutters 252 and 253 are similar in configuration to the shutter 251, and thus the shutter 251 will be mainly described) is made of one wire material as illustrated. The shutter 251 is provided to be rotatable around a rotational axis extending in a direction orthogonal to a sheet conveying direction. The shutter 251 includes abutting portions 251*a* and 251*b* abutted on the downstream end of the sheet conveying direction to shut off the sheet.

A plurality of abutting portions is desirably provided to prevent the sheet from rotating in a width direction when a leading end of the sheet extruded by the extrusion unit 233 contacts with the abutting portions of the shutter 251. In the present exemplary embodiment, two abutting portions are provided. An interval between the abutting portion 251*a* and the abutting portion 251*b* is set shorter than a width of the stored sheet to prevent the sheet from slipping through.

In the present exemplary embodiment, the abutting portions 251*a* and 251*b* have triangular shapes (bent portions) formed by bending the wire materials. The shutter 251 is held between a first support member 261 and a second support member 262 to be vertically regulated. Since the shutter 251 is held between the first support member 261 and the second support member 262 to be included, the sheet is not stuck on the shutter 251.

The first support member 261 includes notches 261*a* and 261*b* that can receive the abutting portions 251*a* and 251*b*. Similarly, the second support member 262 includes notches 262*a* and 262*b*.

When the shutter 251 is moved to the retracing position, the abutting portions 251*a* and 251*b* retract from the sheet conveyance path to be received in the notches 261*a* and 261*b* of the first support member 261 and the notches 262*a* and 262*b* of the second support member 262.

Figure 6:
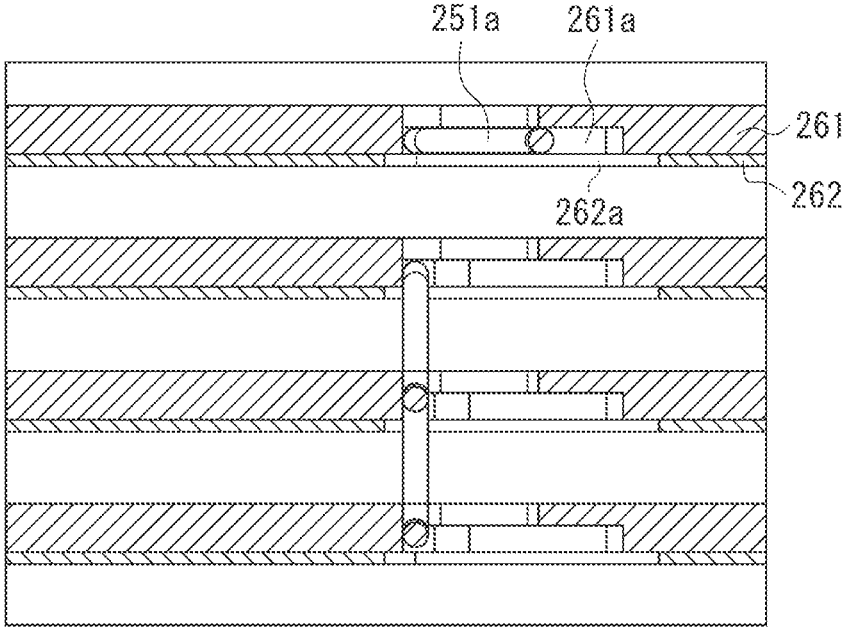
FIG. 6 is a sectional view taken along a vertex of a triangular shape of each abutting portion of the shutter according to the first exemplary embodiment.

FIG. 6 is a sectional view taken along vertexes of the triangular shapes of the abutting portions 251*a* and 251*b* of the shutter in a state where the shutter 251 is at the retracting position.

A lever 280 is integrally attached to one end of the shutter 251. The lever 280, which is supported by side plates 291 and 292 to be rotatable, also functions as a bearing when the shutter rotates to move. The other end of the shutter 251 is supported by a side plate 290 to be rotatable.

The shutter 251 is biased to the shutting-off position by a spring (not illustrated) and self-weight of the shutter 251. This biasing force is set to a level where the shutter 251 is not pushed by the sheet to move.

A part of the shutter 251 is pressed by the actuator 254 at a position away from a rotational center of the lever 280, and accordingly the shutter 251 is rotated to move from the shutting-off position to the retracting position. FIG. 6 illustrates the state where the shutter 251 is at the retracting position. When the sheet stored in the sheet storage unit is discharged, the shutter is moved from the shutting-off position to the retracting position not to interfere with the sheet discharging. Instead of providing the lever 280, a configuration where the shutter 251 is formed into a bent shape and the bent portion is pressed by the actuator 254 to rotate the shutter can be employed.

Next, a characteristic configuration of the present exemplary embodiment will be described referring to FIG. 4C. In a vertical direction illustrated, a leading end of the abutting portion 251*a* of the shutter 251 overlaps the support member 263 of the lower adjacent sheet storage unit 202. Thus, when the shutter 251 is at the shutting-off position, the sheet can be prevented from slipping through.

Further, in the vertical direction illustrated, the leading end of the abutting portion 251*a* overlaps the rotational axis of the shutter 252. By entering the leading end of the abutting portion 251*a* into a space at the base of the triangular shape of the abutting portion 252*a* of the shutter 252, overlapping between the leading end of the abutting portion 251*a* and the rotational axis of the shutter 252 is realized. The shutter 251 and the adjacent shutter 252 can independently move irrespective of a mutual positional relationship without interfering with each other on a rotational locus.

The shutter 251 has been mainly described. The shutters 252 and 253 and the respective abutting portions are similar in configuration to the shutter 251 and the abutting portion.

As described above, according to the first exemplary embodiment, the sheet storage apparatus that includes the plurality of sheet storage units, which is vertically stacked, can be miniaturized in the height direction.

Specifically, the leasing end of the abutting portion 251*a* overlaps the support member 263, which is also serving as a lower guide to guide the lower surface of the sheet stored in the sheet storage unit 201, and the rotational axis of the adjacent shutter 252. Accordingly, the sheet can be prevented from slipping through, and a large sheet storage space can be secured in the height direction. The support member 262 also functions as an upper guide to guide the upper surface of the sheet stored in the sheet storage unit 201.

According to the first exemplary embodiment, the strength of the shutter 251 made of the wire material can be compensated for by holding the shutter 251 between the support member 262 and the support member 261. The shutter 251, which is designed to prevent extrusion of the sheet and to which no strong force is applied, can be made of the wire material.

Further, tinning is achieved by providing a mechanism for opening and closing the shutter 251 outside the sheet conveyance path in the width direction.

If the sheet storage unit can be thinned, the number of sheet storage units provided in the image forming apparatus body can be increased while suppressing the height of the entire apparatus.

Figure 7:
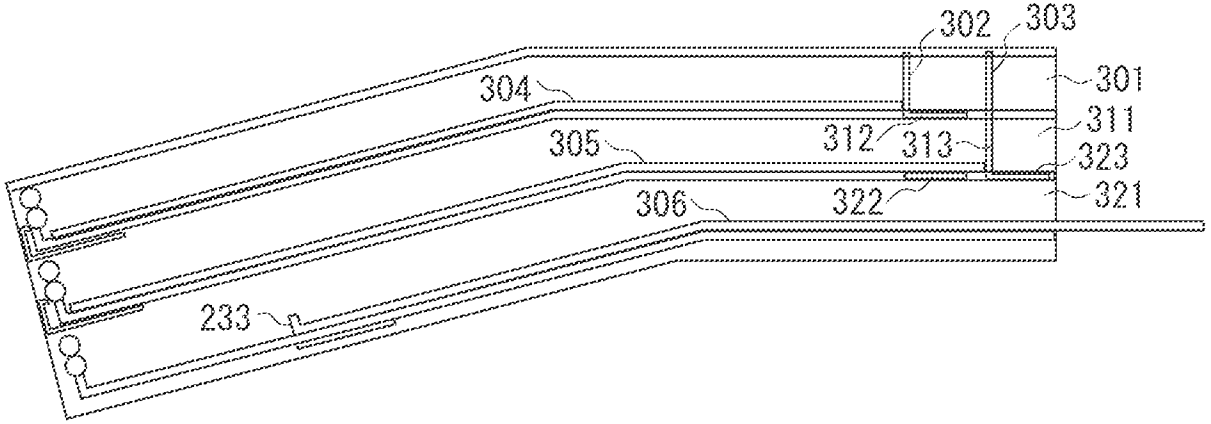
FIG. 7 is a diagram illustrating a sheet storage apparatus according to a first exemplary embodiment.

The above description according to the first exemplary embodiment has been directed to the configuration where each sheet storage unit includes one shutter. However, the present invention is not limited to this configuration. For example, as illustrated in FIG. 7, to store sheets of a plurality of sizes in the sheet storage unit, a plurality of shutters can be provided in the sheet conveying direction to match the sizes of the sheets. An example illustrated in FIG. 7 is a sheet storage apparatus that includes two shutters in each sheet storage unit. A sheet storage unit 301 includes a shutter 302 and a shutter 303, a sheet storage unit 311 includes a shutter 312 and a shutter 313, and a sheet storage unit 321 includes a shutter 322 and a shutter 323. Each shutter configuration is similar to the aforementioned configuration, and thus description thereof will be omitted.

As illustrated in FIG. 7, for example, when small-size paper 304 (e.g., letter size paper) is stored, the sheet is conveyed to the sheet storage unit 301, and the shutter 302 is held at the shutting-off position. When large-size paper 305 (e.g., A4 size paper) is stored, the sheet is conveyed to the sheet storage unit 311. As illustrated in the sheet storage unit 311, the shutter 312 is held at the retracting position, and the shutter 313 is held at the shutting-off position. When the sheet is discharged, as illustrated in the sheet storage unit 321, the shutter 322 and the shutter 323 are both moved to the retracting positions, and the trailing end of the sheet is extruded by the extrusion unit 233 to perform sheet discharging.

The first exemplary embodiment has been directed to the configuration where the shape of the abutting portion 251*a* of the shutter 251 is triangular. However, in the present invention, the shape of the abutting portion 251*a* is not limited to the triangle. Other shapes can provide the same effects as those described above according to the first exemplary embodiment. Basically, as long as the shape of the abutting portion 251*a* is tapered away from the rotational axis of the shutter, the same effects as those of the first exemplary embodiment can be provided.

Figure 8A:
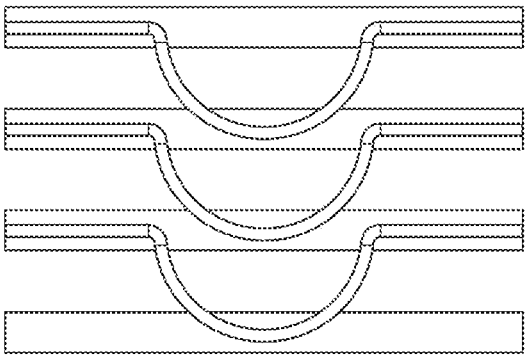
FIGS. 8A and 8B are diagrams illustrating an abutting portion of a shutter according to a second exemplary embodiment seen from a sheet discharging direction.
Figure 8B:
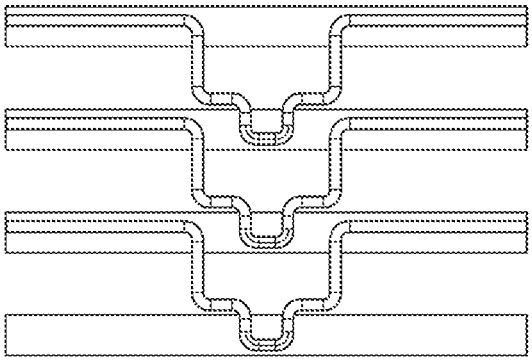

FIGS. 8A and 8B illustrate a configuration of an abutting portion according to a second exemplary embodiment. FIGS. 8A and 8B are diagrams illustrating an abutting portion seen from a sheet discharging direction. A conveyance guide is simplified in FIGS. 8A and 8B. FIG. 8A illustrates an example where the abutting portion is formed into a circular-arc shape. FIG. 8B illustrates an example where the abutting portion is formed into a stepped shape.

The first exemplary embodiment and the second exemplary embodiment have been directed to the configuration where the shutters included in the sheet storage units are similar in shape. However, the present invention is not limited to this configuration. As long as the shutters have shapes illustrated in FIG. 9, even when the shapes of the shutters are different among the sheet storage units, the same effects as those of the first exemplary embodiment can be provided.

Figure 9:
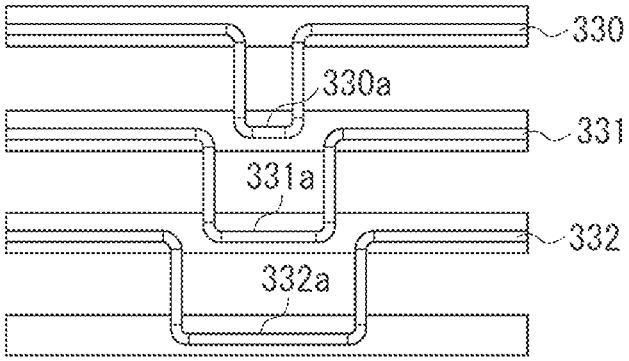
FIG. 9 is a diagram illustrating a shape of a shutter according to a third exemplary embodiment.

FIG. 9 illustrates an abutting portion of a shutter according to a third exemplary embodiment as in the case of FIGS. 8A and 8B, and a conveyance guide is simplified.

As illustrated in FIG. 9, shapes of abutting portions of a shutter 330, a shutter 331, and a shutter 332 are different from one another. A width of the abutting portion 331*a* of the shutter 331 is larger than that of the abutting portion 330*a* of the shutter 330, and a leading end of the abutting portion 330*a* enters into a notch of the abutting portion 331*a*. In other words, the leading end of the abutting portion 330*a* overlaps a rotational axis of the shutter 331. The abutting portion 322*a* of the shutter 332 is wider than the abutting portion 331*a*, and a leading end of the abutting portion 331*a* enters into a notch of the abutting portion 332*a*.

Figure 10:
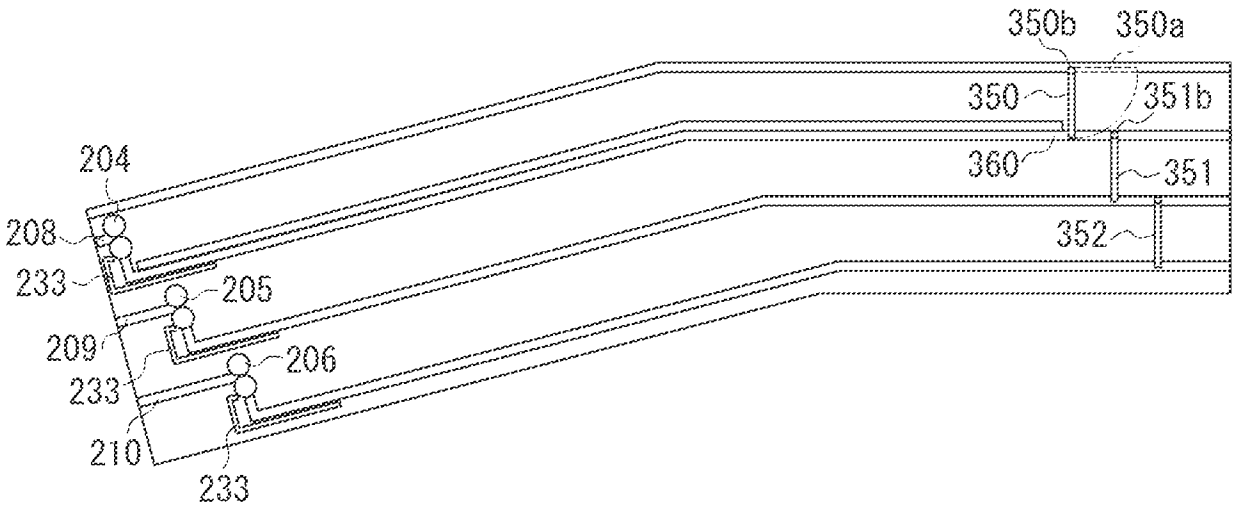
FIG. 10 is a schematic sectional view illustrating a sheet storage unit according to a fourth exemplary embodiment.

As in the case according to a fourth exemplary embodiment, an arrangement of shutters in a sheet conveying direction can be varied from one sheet storage unit to another. FIG. 10 illustrates the fourth exemplary embodiment. FIG. 10 is a schematic sectional view illustrating a sheet storage unit. In FIG. 10, portions similar in configuration and function to those of the first exemplary embodiment are numbered with the same numerals.

According to the first exemplary embodiment, the shutters included in the respective sheet storage units are arranged at the same position in the vertical direction. On the other hand, according to the fourth exemplary embodiment, the shutters are arranged at positions shifted from one another in the sheet conveying direction. According to the fourth exemplary embodiment, a shutter 351 is provided on the downstream side of a shutter 350, and a shutter 352 is provided on the downstream side of the shutter 351.

A shifting amount of each shutter in the sheet conveying direction is determined as follows. In FIG. 10, a broken line 350*a* indicates a state where the shutter 350 is rotated around a rotational axis 350*b* to be set at a retracting position. A chain line indicates a rotational locus of a leading end when the shutter 350 moves from a shutting-off position to the retracting position. A shutter shifting amount is determined to prevent interference between the rotational locus and a rotational axis 351*b* of the shutter 351.

A positional relationship between the shutter 350 (351 and 325) and a conveyance roller 204 (205 and 206) for conveying a sheet to the sheet storage unit is determined by a length of the conveyed sheet. Accordingly, the conveyance roller is arranged to be shifted in the conveying direction by a distance equal to the shutter shifting amount.

Thus, a leading end of an abutting portion of the shutter 350 and the rotational axis 351*b* of the shutter 351 can be arranged to overlap each other in a thickness direction (vertical direction) of a stacking surface. As a result, with a conveyance guide 360 set slightly thicker than a rotational axis diameter of the shutter, a configuration where sheet slipping-through can be prevented can be designed.

An opening and closing mechanism of each shutter is similar to that of the first exemplary embodiment, and thus description thereof will be omitted.

Figure 11:
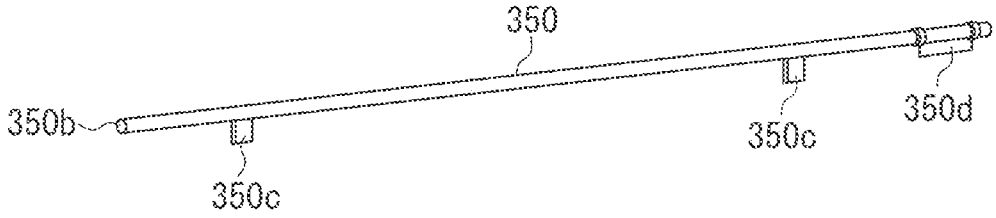
FIG. 11 is a diagram illustrating a shutter according to a fourth exemplary embodiment.

According to the fourth exemplary embodiment, the shutter 350 (351 and 352) can be a molded component having a shape illustrated in FIG. 11. In an example illustrated in FIG. 11, a rotational axis 350*b*, an abutting portion 350*c*, and a lever 350*d* integrally constitute the shutter 350. A difference of the shutter 350 illustrated in FIG. 11 from those of the first to third exemplary embodiments is that the rotational axis 350*b* is continuously connected without any break in a rotational axis direction.

In the fourth exemplary embodiment, since the shutters are arranged to be shifted from one another in the sheet conveying direction, the abutting portion of the adjacent shutter does not pass through the rotational axis 350*b* on the rotational locus. Thus, the shafts can be connected.

As a result, concentricity of the rotational axis can be formed more accurately in this shutter configuration than the shutters formed by bending the wire materials according to the first to third exemplary embodiments. According to the first to third exemplary embodiments, the shutters and the levers are separately formed. However, according to the fourth exemplary embodiment, the shutters and the levers can be integrally formed. Thus, backlash of the shutter and the lever is prevented, and positional accuracy during the shutter opening and closing operation can be improved. In the fourth exemplary embodiment, as in the case of the first to third exemplary embodiments, the shutters can be made of wire materials.

According to the first to fourth exemplary embodiments, a shutter rotational supporting point is set in the upper guide of each sheet storage unit. This is because when the shutter rotational supporting point is set on the upper side, the self-weight of the shutter works to hold the shutter at the shutting-off position, thus enabling a spring force for biasing the shutter to be set low.

However, a rotational supporting point of each shutter can be set in the lower guide of each storage unit. This is advantageous in that at each sheet storage unit, the components including the shutters can be easily unitized. In other words, the apparatus can employ a configuration where the shutter serving as a shutting-off unit is provided in one of the lower guide or the upper guide, and tapered toward the other side.

According to the present exemplary embodiment, at least a part of the shutting-off unit overlaps the rotational axis of the adjacent sheet storage unit in the vertical direction at the shutting-off position. Thus, the sheet storage unit can be designed thin, and the sheet storage apparatus can be miniaturized in the height direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-015895 filed Jan. 30, 2013, which is hereby incorporated by reference herein in its entirety.

What is claimed is:

1. A sheet storage apparatus for storing sheets, comprising:

a sheet storage unit configured to store a sheet conveyed by a sheet conveyance unit, the sheet storage unit comprising:

a lower guide configured to guide a lower surface of the conveyed sheet;

an upper guide configured to guide an upper surface of the conveyed sheet; and a shutting-off unit provided in one of the lower guide and the upper guide, configured to be movable around a rotational axis extending in a direction orthogonal to a conveying direction of the sheet between a shutting-off position at which a downstream end of the conveying direction of the sheet stored in the sheet storage unit is shut off and a retracting position for retracting from the shutting-off position, wherein a plurality of sheet storage units are vertically stacked, and wherein at least a part of the shutting-off unit overlaps with at least part of a rotational axis of a shutting-off unit of an adjacent sheet storage unit in a vertical direction at the shutting-off position.

2. A sheet storage apparatus for storing sheets, comprising:

a sheet storage unit configured to store a sheet conveyed by a sheet conveyance unit, the sheet storage unit comprising:

a lower guide configured to guide a lower surface of the conveyed sheet;

an upper guide configured to guide an upper surface of the conveyed sheet; and a shutting-off unit provided in one of the lower guide and the upper guide, configured to be movable around a rotational axis extending in a direction orthogonal to a conveying direction of the sheet between a shutting-off position at which a downstream end of the conveying direction of the sheet stored in the sheet storage unit is shut off and a retracting position for retracting from the shutting-off position, wherein a plurality of sheet storage units are vertically stacked, wherein the shutting-off unit includes a bent wire material, and wherein at least part of the wire material of one of the plurality of sheet storage units overlaps with at least part of one of the lower guide and the upper guide of an adjacent sheet storage unit in a vertical direction at the shutting-off position.

3. The sheet storage apparatus for storing sheets according to claim 1, wherein the shutting-off unit includes an abutting portion on which the sheet abuts.

4. The sheet storage apparatus for storing sheets according to claim 1, wherein the lower guide and/or the upper guide includes a notch for entry of the shutting-off unit of the adjacent sheet storage unit.

5. The sheet storage apparatus for storing sheets according to claim 1, wherein the shutting-off unit has a shape tapered from the rotational axis toward a leading end of the abutting portion.

6. The sheet storage apparatus for storing sheets according to claim 3, wherein a width of the abutting portion and a width of the notch vary from one shutting-off unit to another, and the shutting-off units are arranged so the abutting portion and the notch of the adjacent shutting-off unit are widened from one shutting-off unit to another.

7. The sheet storage apparatus storing sheets according to claim 3, wherein the shutting-off unit includes a plurality of abutting portions in a width direction of the sheet.

8. The sheet storage apparatus for storing sheets according to claim 1, wherein a plurality of shutting-off units are provided in the sheet conveying direction.

9. The sheet storage apparatus for storing sheets according to claim 1, further comprising an extrusion unit configured to extrude at least a part of the sheet stored in the sheet storage unit out of the sheet storage unit.

10. The sheet storage apparatus for storing sheets according to claim 1, wherein the shutting-off unit is arranged at a position shifted from the shutting-off unit of the adjacent sheet storage unit in the sheet conveying direction to be prevented from interfering with the shutting-off unit of the adjacent sheet storage unit.

11. The sheet storage apparatus for storing sheets according to claim 1, wherein the shutting-off unit includes the bent wire material, and wherein at least part of the wire material of one of the plurality of sheet storage units overlaps with at least part of one of the lower guide and the upper guide of an adjacent sheet storage unit in a vertical direction at the shutting-off position.

12. A sheet storage apparatus configured to store a sheet conveyed by a sheet conveyance unit, comprising:

a plurality of sheet storage units;

wherein each of the plurality of sheet storage units includes a first guide, a second guide facing the first guide and a restricting member movable between a restrict position where moving of the sheet stacked on a stacking surface provided on one of the first guide and the second guide is restricted by protruding toward the first guide from the second guide and allowing position where moving of the sheet stacked on the stacking surface is allowed, and wherein at the restrict position, at least part of the restrict member overlaps with at least part of the first guide in a vertical direction.

13. The sheet storage apparatus according to claim 12, wherein the restrict member restricts movement of the sheet in a conveyance direction of the conveyance unit.

14. The sheet storage apparatus according to claim 12, wherein the restrict member is provided as rotatable between the restrict position and the allowing position.

15. The sheet storage apparatus according to claim 14, wherein at the restrict position, at least part of a restrict member overlaps with at least part of a rotational axis of a restrict member of an adjacent sheet storage unit.

16. The sheet storage apparatus according to claim 12, wherein the restrict member includes a bent wire material.

17. The sheet storage apparatus according to claim 12, wherein the plurality of sheet storage units are vertically stacked.

18. The sheet storage apparatus according to claim 12, wherein each of the sheet storage unit includes an actuator configured to move the restrict member between the restrict position and the allowing position.

19. The sheet storage apparatus according to claim 12, wherein each of the sheet storage units includes an extrusion unit configured to extrude at least a part of the sheet stored in the sheet storage unit out of the sheet storage unit.

20. An image forming apparatus comprising:

an image forming unit configured to form an image on a sheet; and the sheet storage apparatus according to claim 12, wherein each of the sheet storage units stores the sheet on which the image is formed by the image forming unit.

21. The sheet storage apparatus according to claim 12, wherein a notch is provided on the first guide, the restrict member entering into the notch at the restrict position.

* * * * *